US009844245B1

(12) United States Patent
Naylor

(10) Patent No.: US 9,844,245 B1
(45) Date of Patent: Dec. 19, 2017

(54) TWO PART BUTTON SYSTEM WITH A SNAP-ON DECORATIVE TOP PIECE

(71) Applicant: Nathan Naylor, Bradenton, FL (US)

(72) Inventor: Nathan Naylor, Bradenton, FL (US)

( * ) Notice: Subject to any disclaimer, the term of this patent is extended or adjusted under 35 U.S.C. 154(b) by 213 days.

(21) Appl. No.: 14/840,136

(22) Filed: Aug. 31, 2015

(51) Int. Cl.

| | |
|---|---|
| ***A44B 1/14*** | (2006.01) |
| ***A44B 1/04*** | (2006.01) |
| ***A44B 1/06*** | (2006.01) |
| ***A44B 1/22*** | (2006.01) |

(52) U.S. Cl.
CPC ..... *A44B 1/14* (2013.01); *A44B 1/04* (2013.01); *A44B 1/06* (2013.01); *A44B 1/22* (2013.01)

(58) Field of Classification Search
CPC ... Y10T 24/36; Y10T 24/367; Y10T 24/3694; A44B 1/14; A44B 1/04; A44B 1/06; A44B 1/22
See application file for complete search history.

(56) References Cited

U.S. PATENT DOCUMENTS 2,087,074 A * 7/1937 Tucker ..... A44B 1/08 24/113 MP
3,141,211 A * 7/1964 Blake ..... A43B 23/24 24/114.4
4,793,155 A * 12/1988 Law ..... A44B 1/123 24/113 R
2008/0244873 A1* 10/2008 Yamashita ..... A44B 1/04 24/90.1
2014/0082900 A1* 3/2014 Smith ..... A44B 1/14 24/594.11

FOREIGN PATENT DOCUMENTS

DE 19738263 A1 3/1999
JP 2008253616 A * 10/2008 ..... A44B 1/04

* cited by examiner

*Primary Examiner* — Robert Sandy
*Assistant Examiner* — Matthew J Sullivan
(74) *Attorney, Agent, or Firm* — Dorothy S. Morse

(57) ABSTRACT

A two part button system provides secure and easy snap-on/snap-off action between a domed, perforated, flexing decorative top piece and a button base member attached to fabric or apparel. When the parts are in their usable positions with respect to one another, their configurations create a small crevice between opposed perimeter edges. Separation and removal of the top piece from the base member occurs only when a compressing/prying force is applied in the crevice, allowing the top piece to be easily and promptly lifted away from the base member, and optionally replaced by a substitute top piece thus changing the button system appearance. The decorative options for top pieces are unlimited, allowing for a traditional looking and functioning base member that is connected to fabric or apparel in the usual fashion, but able one-at-a-time to accept numerous and various decorative top pieces as desired and changed at will.

9 Claims, 3 Drawing Sheets

TWO PART BUTTON SYSTEM WITH A SNAP-ON DECORATIVE TOP PIECE

CROSS-REFERENCES TO RELATED APPLICATIONS

None.

BACKGROUND—FIELD OF THE INVENTION

This invention relates to closures and decorative accessories for apparel/fabric, specifically to a two part button system allowing a secure and easy snap-on/snap-off action between a decorative top piece and a button base member, after the base member has been attached to fabric/apparel. When they are in their usable positions with respect to one another, the top piece and base member have opposed perimeter configurations that create a small crevice between them. Connection of the decorative top piece to the button base member is secure during use, with separation and removal of the top piece from the base member occurring only when a combined compressing and upward prying force is applied in the crevice, allowing the top piece thereafter to be easily and promptly lifted away from the base member and optionally replaced by a substitute top piece that changes the button system appearance. Also, since the present invention has a button base member that is nearly indistinguishable in form and function from a traditional solitaire button, except for the slight downwardly-narrowing sloped wall leading to an inset groove at the base of its recessed thread pan, when desired and as an alternative fashion statement, the button base member may be worn without the attachment of a decorative top piece. The options for decorative top pieces are unlimited, allowing for a traditional looking and functioning base member that is connected to fabric/apparel in the usual fashion, but also able one-at-a-time to accept numerous and various decorative top pieces as desired and changed at will.

BACKGROUND—DESCRIPTION OF THE RELATED ART

The two part button system of the present invention may include many alternatively used snap-on/snap-off decorative top pieces with its button base member in apparel and fabric applications, and is a fashionable way to enhance one's personal style. It solves problems associated with the current time consuming and complicated process of sewing new buttons onto fabric or apparel to change the color or look of one's clothing. Furthermore, neither the 'slip-over' or 'slip-on' temporary decorative button covers currently available in the prior art, nor the more permanent and difficult to remove decorative button pieces also available, allow for the continuity of function/utility, or the ease of style change, in the same manner and with the same structure that is provided by the present invention.

The closest prior art relating to the present invention appears to be disclosed in the published U.S. Patent Application 20080244873A1 filed by Yamashita. However, there are many important differences between the Yamashita invention and the present invention, which include the following. The button design incorporated as a part of the present invention allows for prompt and easy use of its two part snap-on/snap-off system, with ease of use provided during the steps of decorative top piece attachment as well as detachment, while the Yamashita invention provides easy attachment of its top ornamented part 20, but purposefully difficult detachment thereof. A small angular crevice is formed between the opposed perimeter edges of the decorative top piece and button base member of the present invention when they are in their usable positions with respect to one another, and allows ease of separation between them when a combined compressing and upward prying force is applied within the crevice. The compressing/prying force pinches the fenestrated and domed angular insertion protrusion of the present invention decorative top pieces into a sufficiently collapsed/contracted configuration for it to pass through the slight downwardly-narrowing and upwardly-widening inner sloped wall for release of decorative top piece from the present invention button base member, which is much different from known permanent closure systems. No crevice or inter-space between its top ornamented part 20 and its bottom part 30 is visible in the Yamashita drawing sheets, and no such crevice or interspace is mentioned in the Yamashita specification. Also, the present invention has a button base member that is nearly indistinguishable in form and function from a traditional solitaire button, except for the slight downwardly-narrowing inner sloped wall leading to a substantially hidden inset groove at the base of its recessed thread pan. If one chooses to adorn it with a decorative top piece, the outwardly flared bottom edge of the fenestrated, domed, and angular insertion protrusion of the decorative top piece slides along and downwardly beyond a downwardly-narrowing inner sloped wall into the angled inset groove of the recessed thread pan with the correct flex that allows the fenestrated, domed, and angular insertion protrusion to first compress for entry into the groove and then regain an expanded configuration while it remains in the groove to maintain the decorative top piece securely connected to the button base member until deliberately released by a combined compressing and upward prying force applied to the perimeter crevice existing between the top piece and the base member. Thus, it is a portion of the decorative top piece in the present invention that flexes in both inward and outward directions respectively during connection and separation of its two parts, and not its button base member. Distinctively different structure exists in the Yamashita invention. Both of the embodiments for a separable ornamented button presented in the Yamashita disclosure have similar semi-permanent attachment mechanisms that result in difficult detachment, alternatively involving the inward pressing of the protrusion 33 on bottom body 30 (see paragraph 0034 of the Yamashita disclosure) or the outward spreading of the protrusion 33' on bottom body 30' (see paragraph 0043 of the Yamashita disclosure). In contrast, it is the distinguishable angular approach used in the present invention, involving the flexing of a portion of its decorative top piece during connection of its outwardly flared bottom edge to the angled inset groove of the button base member that as guided by the downwardly-narrowing inner sloped wall yields the appropriate tension between its two parts needed for a secure connection between them, until combined compressing and upward prying forces release and allow deliberate separation by the user.

Another invention having some relevance to the present invention is the German patent DE 19738263 (A1) issued 1999 Mar. 4 to Horst Harrer for a button used with an exchangeable front part. The Harrer invention comprises a button (1) with a central front opening surrounded by a circumferential bead (3), and this front opening communicating with a groove (4) located under the bead 3. The decorative front element (2) of the Harrer invention has a cylindrical part (5) of a smaller diameter than its exposed decorative surface, and this cylindrical part (5) is hidden from view when button (1) and the decorative front element (2) are connected to one another. A resilient outer lip (6) is circumferentially located around the lower edge of the cylindrical part (5) which can be positioned in the groove (4) of button (1) to fix the decorative front element (2) to the button (1). As the cylindrical part (5) of the decorative front element (2) is aligned with the circumferential bead (3) of the Harrer button (1), and decorative front element (2) is pressed toward button (1), portions of the resilient outer lip (6) on the lower exterior edge of cylindrical part (5) temporarily stretch, roll, and/or otherwise deform until resilient outer lip (6) moves past circumferential bead (3) and into groove (4), after which resilient outer lip (6) regains its original configuration that allows it to remain in groove (4) for connection of decorative front element (2) from button (1). Removal of the Harrer decorative front element (2) from button (1) involves portions of the resilient outer lip (6) again temporarily deforming until resilient outer lip (6) moves upwardly past circumferential bead (3) and away from button (1), and once beyond bead (3) resilient outer lip (6) thereafter regain its original configuration. The present invention is distinguishable from the Harrer invention as the present invention comprises of a button base member that is nearly indistinguishable in form and function from a traditional solitaire button. Detachment of the present invention decorative top piece is also different from the Harrer invention, occurring as a result of combined compressing and upward prying forces applied under the decorative top piece within a crevice formed between the decorative top piece and the button base member when they are joined, and with present invention detachment further occurring as a result of the fenestrated and domed angular insertion protrusion flexing inward into an at least partially collapsed configuration in response to the compressing/prying force so that the compressed configuration of the fenestrated and domed angular insertion protrusion can again move upwardly beyond the downwardly-narrowing/upwardly-widening sloped wall passage and then also beyond the central opening of the button base member. The cylindrical part (5) of the decorative front element (2) in the Harrer invention does not flex, instead its protruding circumferential resilient member (6) stretches and flattens into a thinner configuration allowing it and the attached/rigid lower portion of cylindrical part (5) to move past circumferential bead (3) toward button (1) for connection of decorative front element (2) to button (1). In the reverse, during attachment of a decorative top piece in the present invention, its flexing fenestrated and domed angular insertion protrusion is compressed and pushed through the slight downwardly-narrowing sloped wall passage (not a circumferential bead) leading to the inset groove of the button base member, and after reaching the angled inset groove in communication with the button base member's recessed thread pan the flexing fenestrated and domed angular insertion protrusion regains its expanded configuration that creates an outward expansion force that securely holds the decorative top piece to the button base member. Upward pulling on the present invention decorative top piece will not release it from its connected button base member. In contrast, an upward pulling force applied to the Harrer decorative front element (2) will cause its resilient outer lip (6) to deform, allowing decorative front element (2) to separate from its attached button (1). The fenestrated and domed angular protrusion of the present invention enhances/assists the easy separation of the present invention decorative top piece from its connected button base member by flexing inward in response to a combined compressing and upward prying force for prompt and easy decorative top piece detachment. This is in direct contrast to the structure of the Harrer invention, which has a cylindrical part (5) that is solidly round, thus providing no outward, or inward, flexing of cylindrical part (5) that eases attachment or separation of its decorative front element (2) and button (1). The downwardly-narrowing sloped wall used in the present invention is also different in configuration from that of the circumferential bead (3) used in Harrer invention, further distancing the present invention structure from that in the Harrer invention.

BRIEF SUMMARY OF THE INVENTION

The primary objective of this invention is to create a traditional looking button with a decorative top piece option that can be easily and securely affixed, exchanged, or removed when desired without changing the overall form or function of the button base member.

Another objective is to allow a variety of options for the decorative top pieces other than solid surfaces, such as, but not limited to: fabric, wood, shell, gemstones, plastics, glass, and metals.

It is also an objective of this invention to provide an easy snap-on/snap-off function between its top piece and button base member that relies on prompt separation thereof upon demand through use of a tool or utensil applying a combined compressing and upward prying force in the slight crevice formed between the opposed perimeter edges of its two parts when they become connected to one another in their desired positions of use and the button base member is secured to apparel or other support surface.

It is a further objective of this invention for tension to be created by the fenestrated, domed, and angular insertion protrusion of its decorative top piece, while it is flexing and sliding inward to an inset groove in the button base member at the bottom of its recessed thread pan, to secure its two button parts together until intentionally separated by the user.

Yet another objective of this invention is to create a button system of durable construction for longevity, and a comfortable shape to hold, or use, during operation with or without the decorative top piece.

COMPONENT LIST

Figure 1:
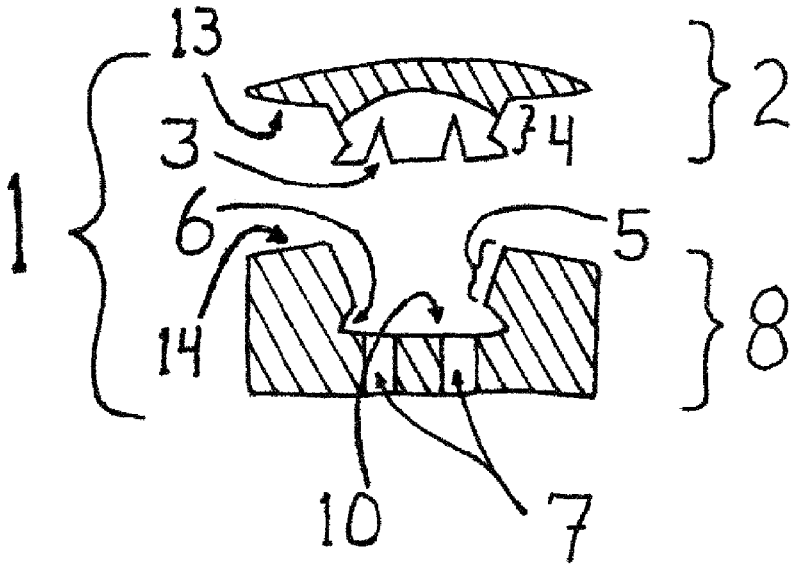
FIG. 1 is an exploded side view in cross-section of the most preferred embodiment of the invention, showing the snap-on/snap-off decorative top piece poised for connection to the button base member.

1—Present invention two-part button system
2—Decorative top piece
3—Perforations/fenestrations
4—Fenestrated and domed angular insertion protrusion
5—Downwardly-narrowing sloped inner wall of button base member 8
6—Inset groove within recessed thread pan 10
7—Holes in button base member 8 for thread or other attachment means
8—Button base member
9—Crevice
10—Recessed thread pan
11—Compressing/Prying tool (example)
12—Compressing/Prying edges of tool 11
13—Underside perimeter surface of decorative top piece 2 creating top surface of crevice 9
14—Top perimeter surface of button base member 8 creating bottom surface of crevice 9

DETAILED DESCRIPTION OF THE INVENTION

The present invention 1 is a two part button system allowing a secure and easy snap-on/snap-off action between a decorative top piece 2 and a button base member 8, after the button base member 8 has been attached to fabric/apparel (not shown). When they are in their usable positions with respect to one another, the decorative top piece 2 and the button base member 8 have opposed perimeter configurations that create a small/slight crevice 9 between them, defined by the straight or slightly angled underside perimeter surface 13 of decorative top piece 2 and the angled top perimeter surface 14 of button base member 8. Connection of the decorative top piece 2 to the button base member 8 is secure during use, with separation and removal of the decorative top piece 2 from the button base member 8 nearly impossible without a combined compressing and upward prying force applied in crevice 9, thereafter allowing the decorative top piece 2 to be easily and promptly lifted away from the button base member 8 and optionally replaced by a substitute top piece 2 that changes present invention button system 1 appearance. Also, since the present invention 1 has a button base member 8 that is nearly indistinguishable in form and function from a traditional solitaire button (not shown), except for the downwardly-narrowing sloped wall 5 leading to an inset groove 6 at the base of its recessed thread pan 10, when desired and as an alternative fashion statement, the button base member 8 may be worn without the attachment of a decorative top piece 2. The design options for decorative top pieces 2 are unlimited, allowing for a traditional looking and functioning base member that is connected to fabric/apparel in the usual fashion to be used alone, but also able one-at-a-time to accept numerous and varied decorative top pieces 2 as desired and changed at will.

Figure 2:
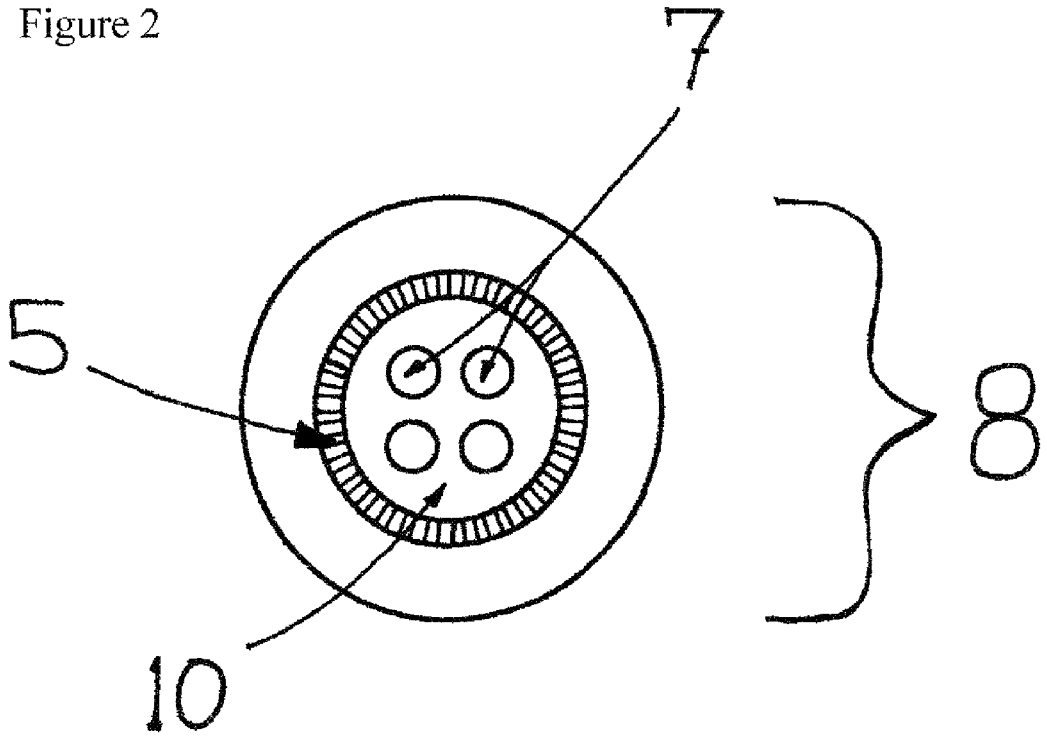
FIG. 2 is a top view of the button base member in the most preferred embodiment of the invention.
Figure 3:
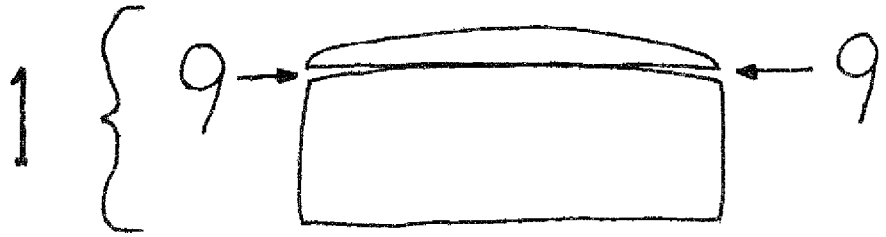
FIG. 3 is a side view of a decorative top piece joined to a button base member in the most preferred embodiment of the present invention, and shows the most preferred positioning and configuration for one example of the slight perimeter crevice used in separation of the decorative top piece from the button base member.
Figure 4:
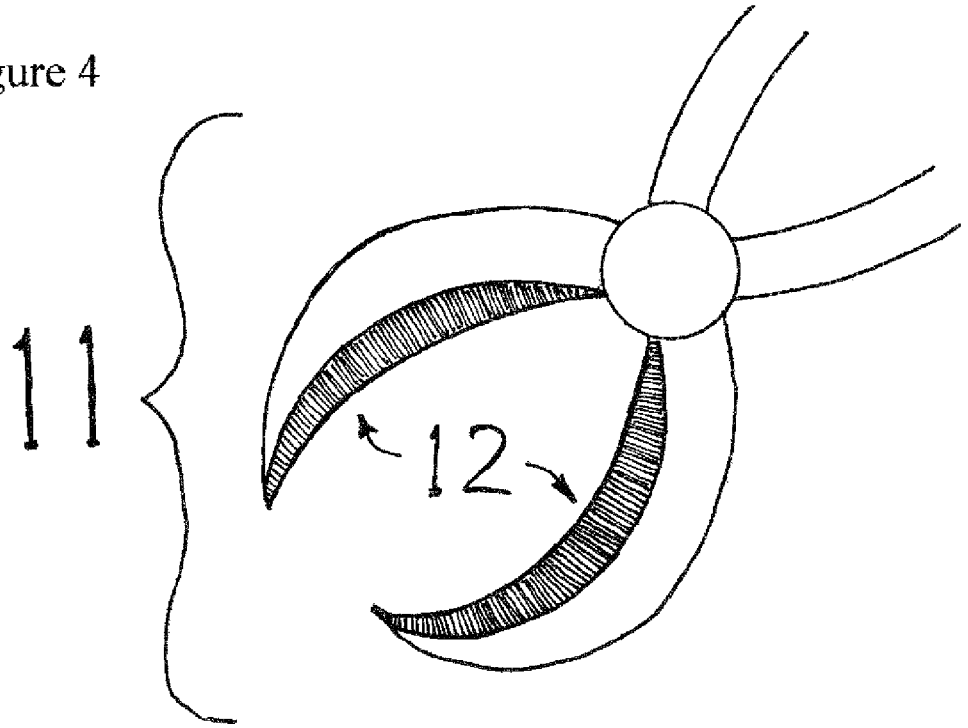
FIG. 4 is a perspective view of one example of a tool that can be placed into the slight perimeter crevice between the decorative top piece and the button base member to apply a combined compressing and upward prying force to release the decorative top piece from the button base member.
Figure 5:
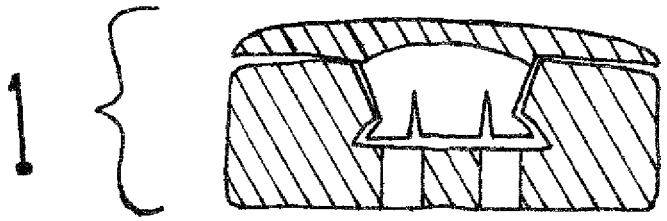
FIG. 5 is a cross-sectional side view of the most preferred embodiment of the invention showing the decorative top piece connected to the button base member.

FIG. 1 is an exploded side view in cross-section of the most preferred embodiment of the invention, showing the snap-on/snap-off decorative top piece 2 poised for connection to the button base member 8, while FIG. 5 shows a side view in cross-section of decorative top piece 2 connected to the button base member 8. FIG. 2 is a top view of the button base member 8 showing multiple thread/attachment holes 7 through its recessed thread pan 10. FIG. 3 is a side view of a decorative top piece 2 joined to a button base member 8 in the most preferred embodiment of the present invention 1 and creating the slight crevice 9 into which a tool or utensil (such as but not limited to that shown in FIG. 4 and identified by the number 11) can be used to easily apply a combined compressing and upward prying force to release decorative top piece 2 from button base member 8. The straight (substantially horizontally-extending) or slightly upwardly-angled underside perimeter surface 13 of decorative top piece 2 and the angled top perimeter surface 14 of button base member 8 defining crevice 9 are respectively shown in FIGS. 1, 3, and 5. Until deliberately released by a user (not shown), decorative top piece 2 and button base member 8 stay firmly connected to one another even when subjected to inadvertent contact or an upward pulling force applied to decorative top piece 2, avoiding casual release and unplanned loss of decorative top pieces 2 during use. FIG. 1 shows decorative top piece 2 having a fenestrated and domed angular insertion protrusion 4, the flexing capability of which is provided in part by angled perforations 3. However, fenestrated and domed angular insertion protrusion 4 also preferably comprises material creating an outward spring force when inserted into the inset groove 6 of the recessed thread pan 10 of button base member 8 to further assist in securely holding decorative top piece 2 in its desired position of use until removed by a combined compressing and upward prying force applied to slight crevice 9.

FIG. 1 also shows the angled inset groove 6 adjacent to the recessed thread pan 10 of the button base member 8 into which the fenestrated and domed angular insertion protrusion 4 of the decorative top piece 2 is snapped, including its outwardly flared bottom edge of the fenestrated and domed angular insertion protrusion 4 automatically expanding after initially being received by, and then moving downwardly beyond, the downwardly-narrowing sloped inner wall 5 of the button base member 8. In FIG. 2 the recessed thread pan 10 of the button base member 8 is shown as having four thread/attachment holes 7 used for threaded or other attachment of the button base member 8 to fabric/apparel (not shown). However, the size, number, placement, and relative positioning of holes 7 shown in FIG. 2 are not critical, and merely provided as an example. Also, rounded corners of the button base member 8 are preferred as generally shown in FIGS. 1, 3, and 5, but not critical. Materials for decorative top piece 2 could include, but are not limited to fabric, wood, gemstones, metals, glass, shell, and plastics. Furthermore, materials for button base member 8 could include, but are not limited to metal, plastics, glass, shell, wood, and gemstones.

FIG. 4 is a perspective view of one example of the configuration of a tool 11 with opposing prying edges 12 that can be placed into the slight crevice 9 between the decorative top piece 2 and the button base member 8 and used to apply a combined compressing and upward prying force to cause inward flexing of the fenestrated and domed angular insertion protrusion 4 for release of decorative top piece 2 from button base member 8. To use the most preferred embodiments of the present invention, one would first sew/attach the button base member 8 to the fabric/apparel, or another support surface (not shown). Then if one chooses, a decorative top piece 2 may be snapped into place, easily, promptly, and without use of a tool 11, or other tool/utensil (not shown).

While the written description of the invention herein is intended to enable one of ordinary skill to make and use its best mode, it should also be appreciated that the invention disclosure only provides examples of specific embodiments and methods, and many variations, combinations, and equivalents also exist which are not specifically mentioned. The present invention should therefore not be considered as limited to the above-described embodiments, methods, and examples, or the language in the accompanying Abstract, but instead encompassing all embodiments and methods within the scope and spirit of the invention as defined in the appended claims.

I claim:

1. A two part button system comprising:

at least one decorative top piece having an underside perimeter surface and a fenestrated and domed angular insertion protrusion, said fenestrated and domed angular insertion protrusion centrally depending from said underside perimeter surface, said fenestrated and domed angular insertion protrusion further having a outwardly flared bottom edge movable between an expanded configuration and a compressed configuration, said underside perimeter surface selected from a group consisting of horizontally-extending perimeter surfaces and slightly upwardly-angled perimeter surfaces;

a button base member having a top surface with a central opening in communication with a recessed thread pan, said top surface having an inner perimeter edge adjacent to said central opening and an outer perimeter edge remote from said central opening, said inner perimeter edge and said outer perimeter edge each having an elevation dimension, said elevation dimension of said inner perimeter edge being greater than said elevation dimension of said outer perimeter edge and creating a slightly downward angle to said top surface, said recessed thread pan having an outer perimeter with an angled inset groove, said angled inset groove complementary in configuration to that of said outwardly flared bottom edge when in said expanded configuration, allowing secure engagement between said at least one decorative top piece and said button base member when said outwardly flared bottom edge is received within said angled inset groove, and said button base member also having a downwardly-narrowing sloped inner wall between said inner perimeter edge of said top surface and said inset groove of said recessed thread pan; and said underside perimeter surface of said decorative top piece and said outer perimeter edge of said button base member together creating a small crevice when said fenestrated and domed angular insertion protrusion of said decorative top piece is received in said inset groove, said crevice configured for receipt of a combined compressing and upward prying force pushing inwardly against said domed and fenestrated angular insertion protrusion until said outwardly flared bottom edge is in said compressed configuration and withdrawn from said angled inset groove, while said upward prying portion of said combined force directed at said small crevice also pushes upwardly against said underside perimeter surface of said at least one decorative top piece, which in combination with said slightly downward angle in said top surface of said bottom base member causes said underside perimeter surface to move in an upwardly direction away from said top surface of said button base member while concurrently drawing said outwardly flared bottom edge of said angular insertion protrusion upwardly beyond said downwardly-narrowing sloped inner wall, wherein one said at least one decorative top piece can be securely combined with said button base member by centering said one at least one decorative top piece above said downwardly-narrowing sloped inner wall of said button base member and applying a downward force against said one at least one decorative top piece until said downwardly-narrowing sloped inner wall causes movement of said outwardly flared bottom edge into said collapsed configuration, allowing entry thereof into said thread pan and concurrent movement of said outwardly flared bottom edge into said expanded configuration and entry into said angled inset groove, receipt of said outwardly flared bottom edge into said angled inset groove preventing separation of said decorative top piece from said button base member until a combined compressing and upward prying force applied to said small crevice first moves said outwardly flared bottom edge into said compressed configuration causing release from said angled inset groove, and thereafter forcing said underside perimeter surface of said decorative top piece to move away from said top surface of said button base member while said downwardly-narrowing sloped inner wall concurrently guides complete withdrawal of said angular insertion protrusion from said central opening in said button base member, allowing for a change in appearance of said button system.

2. The system of claim 1 further comprising a plurality of said decorative top pieces configured for connection one-at-a-time to said button base member, said decorative top pieces each having a visual appearance distinctive from one another.

3. The system of claim 1 wherein said button base member further comprises slightly rounded corners.

4. The system of claim 1 wherein said fenestrated and domed angular insertion protrusion further comprises material creating an outward spring force to move said outwardly flared bottom edge from said compressed configuration into said expanded configuration and cause receipt thereof into said angled inset groove of said recessed thread pan of said button base member, said outward spring force securely holding said decorative top piece in place until removed by a combined compressing and upward prying force applied to said small crevice.

5. The system of claim 1 wherein said button base member resembles a traditional solitaire button.

6. The system of claim 1 wherein said button base member has at least a minimally decorative configuration allowing use of said button base member without said decorative top piece.

7. The system of claim 1 wherein said angular insertion protrusion of said decorative top piece has a configuration and size complementary to that of said recessed thread pan in said button base member, allowing easy and prompt receipt of said outwardly flared bottom edge of said angular insertion protrusion into said recessed thread pan and also allowing secure connection between said outwardly flared bottom edge of said at least one decorative top piece within said angled inset groove of said outer perimeter of said thread pan of said button base member, avoiding inadvertent release and unplanned loss of said at least one decorative top piece during use.

8. A method for using the system of claim 1 comprising the steps of:

selecting one said at least one decorative top piece;

centering said selected decorative top piece directly over said button base member;

pressing said outwardly flared bottom edge of said angular insertion protrusion of said selected decorative top piece into said central opening of said button base member; and further pressing said outwardly flared bottom edge of said angular insertion protrusion along and downwardly beyond said downwardly-narrowing sloped inner wall toward said recessed thread pan, while moving said outwardly flared bottom edge increasingly toward said compressed configuration and until said angular insertion protrusion reaches said recessed thread pan and said angled inset groove in communication with said recessed thread pan, and then securely snaps into said angled inset groove, wherein said outwardly flared bottom edge of said fenestrated and domed angular insertion protrusion moves into said expanded configuration, securely connecting said decorative top piece to said button base member with a small crevice established between them.

9. The method of claim 8 further comprising the steps of:

providing a device selected from a group consisting of tools and utensils, and at least two of said decorative top pieces;

using said device to apply a combined compressing and upward prying force in said small crevice until said outwardly flared bottom edge of said fenestrated and domed angular insertion protrusion of said decorative top piece securely snapped into said angled inset groove moves into said compressed configuration and past said downwardly-narrowing sloped inner wall of said button base member toward said central opening; and continuing to use said device to apply a combined compressing and upward force against said fenestrated and domed angular insertion protrusion of said securely snapped decorative top piece until said fenestrated and domed angular insertion protrusion moves through said central opening and away from said button base member for release of said securely snapped decorative top piece from said button base member, thus allowing for attachment of an alternative selected one of said at least two decorative top pieces to said button base member.

* * * * *